US006076632A

United States Patent [19]

Schuhmacher et al.

[11] Patent Number: 6,076,632

[45] Date of Patent: Jun. 20, 2000

[54] CROSS FLOW BAFFLE MUFFLER

[75] Inventors: Kory J. Schuhmacher, Oregon; Gary D. Goplen, Stoughton, both of Wis.

[73] Assignee: Nelson Industries, Inc., Stoughton, Wis.

[21] Appl. No.: 09/211,683

[22] Filed: Dec. 14, 1998

[51] Int. Cl.[7] ..... F01N 7/18

[52] U.S. Cl. ..... 181/282; 181/272

[58] Field of Search ..... 181/249, 255, 181/264, 269, 272, 282

[56] References Cited

U.S. PATENT DOCUMENTS

| | | |
|---|---|---|
| 2,975,854 | 3/1961 | Bakke et al. . |
| 3,378,009 | 4/1968 | Gordon . |
| 3,404,749 | 10/1968 | Miller et al. . |
| 3,709,320 | 1/1973 | Hollerl et al. . |
| 3,863,734 | 2/1975 | Pawlina . |
| 4,164,989 | 8/1979 | Lux et al. . |
| 4,165,798 | 8/1979 | Martinez . |
| 4,415,059 | 11/1983 | Hayashi ..... 181/272 |
| 4,700,806 | 10/1987 | Harwood . |
| 4,736,817 | 4/1988 | Harwood . |
| 4,741,411 | 5/1988 | Stricker . |
| 4,759,423 | 7/1988 | Harwood et al. . |
| 4,765,437 | 8/1988 | Harwood et al. . |
| 4,766,983 | 8/1988 | Tamba et al. . |
| 4,809,812 | 3/1989 | Flugger . |
| 4,821,840 | 4/1989 | Harwood et al. . |
| 4,836,330 | 6/1989 | Harwood et al. . |
| 4,847,965 | 7/1989 | Harwood et al. . |
| 4,860,853 | 8/1989 | Moring, III . |
| 4,865,154 | 9/1989 | Hanson et al. . |
| 4,894,987 | 1/1990 | Harwood et al. . |
| 4,901,815 | 2/1990 | Harwood et al. . |
| 4,909,348 | 3/1990 | Harwood et al. . |
| 4,924,968 | 5/1990 | Moring, III et al. . |
| 4,928,372 | 5/1990 | Harwood et al. . |
| 4,941,545 | 7/1990 | Wilcox et al. . |
| 4,958,701 | 9/1990 | Moring, III . |
| 4,972,921 | 11/1990 | Takada et al. . |
| 5,004,069 | 4/1991 | Van Blaircum et al. . |
| 5,042,125 | 8/1991 | Harwood et al. . |
| 5,147,987 | 9/1992 | Richardson et al. . |
| 5,164,551 | 11/1992 | Harwood et al. . |
| 5,173,577 | 12/1992 | Clegg et al. . |
| 5,229,557 | 7/1993 | Allman et al. . |
| 5,252,788 | 10/1993 | Emrick et al. . |
| 5,315,075 | 5/1994 | Junginger et al. . |
| 5,326,943 | 7/1994 | Macaulay . |
| 5,327,722 | 7/1994 | Clegg et al. . |
| 5,428,194 | 6/1995 | Emrick et al. . |
| 5,448,831 | 9/1995 | Harwood . |
| 5,473,891 | 12/1995 | Baxter et al. . |
| 5,504,280 | 4/1996 | Woods . |
| 5,563,383 | 10/1996 | Harwood . |
| 5,563,385 | 10/1996 | Harwood . |
| 5,581,056 | 12/1996 | Bellgardt et al. . |
| 5,597,986 | 1/1997 | Harwood et al. . |
| 5,717,173 | 2/1998 | Gerber et al. . |
| 5,773,770 | 6/1998 | Jones . |
| 5,859,394 | 1/1999 | Seehaus et al. . |

*Primary Examiner*—Khanh Dang
*Attorney, Agent, or Firm*—Andrus, Sceales, Starke & Sawall

[57] ABSTRACT

A muffler (12) has first and second outer shell members (14 and 16), and first and second inner baffle members (18 and 20). The inner baffle members are identical to each other and parallel to each other and rotated 180° relative to each other about an axis (22) perpendicular to such parallel extension. The baffle members have oppositely facing laterally offset formed expansion chambers (32 and 34) partially overlapped to provide exhaust flow communication therebetween. The structural combination enables usage of identical components (18 and 20), which improves manufacturing efficiency and provides a cost reduction.

21 Claims, 5 Drawing Sheets

CROSS FLOW BAFFLE MUFFLER

BACKGROUND AND SUMMARY

The invention relates to noise-silencing mufflers.

The invention arose during muffler development efforts, including those directed to solving problems in box-style mufflers, including muffler shell noise and poor muffler silencing. Since cost is almost always a concern, the solution to the two noted problems must also be cost effective. Box-style or stamped mufflers tend to radiate noise from their flat exterior surfaces. This characteristic is called shell noise and is most often a concern because of its harsh sound and adverse effects on muffler silencing. Also of concern with stamped mufflers is overall acoustic effectiveness. Because these types of mufflers are often constrained to a certain size and shape, their physical layout is not always conducive to good silencing.

The present invention addresses and solves the noted problems in a particularly cost effective manner using a simple design. In one aspect the invention enables usage of identical parts within the muffler, which improves manufacturing efficiency and provides a cost reduction. Assembly of the muffler is also easy because the majority of the muffler's internal parts are designed into two cross flow baffles. In accordance with the preferred embodiment, to combat the shell noise problem, the flow from the inlet is directed into one of two interior chambers of the muffler, formed by placing two of the cross flow baffles back to back. By letting the exhaust flow expand first in an interior chamber, the pressure pulses from the engine are less likely to cause exterior shell noise problems since they are damped considerably before reaching the muffler's outer shell. Stiffening bosses may be provided on larger flat areas of the baffles to control internal shell noise. To increase silencing capability, four chambers are created within the muffler by using a twin baffle design, along with two additional volumes between the outer shells and baffles. In one aspect, a horseshoe-shaped cross flow baffle is designed to provide the twin internal silencing chambers with a desired flow path and area between them. The configuration increases the acoustical effectiveness of the muffler.

DETAILED DESCRIPTION OF THE INVENTION

Figure 1:
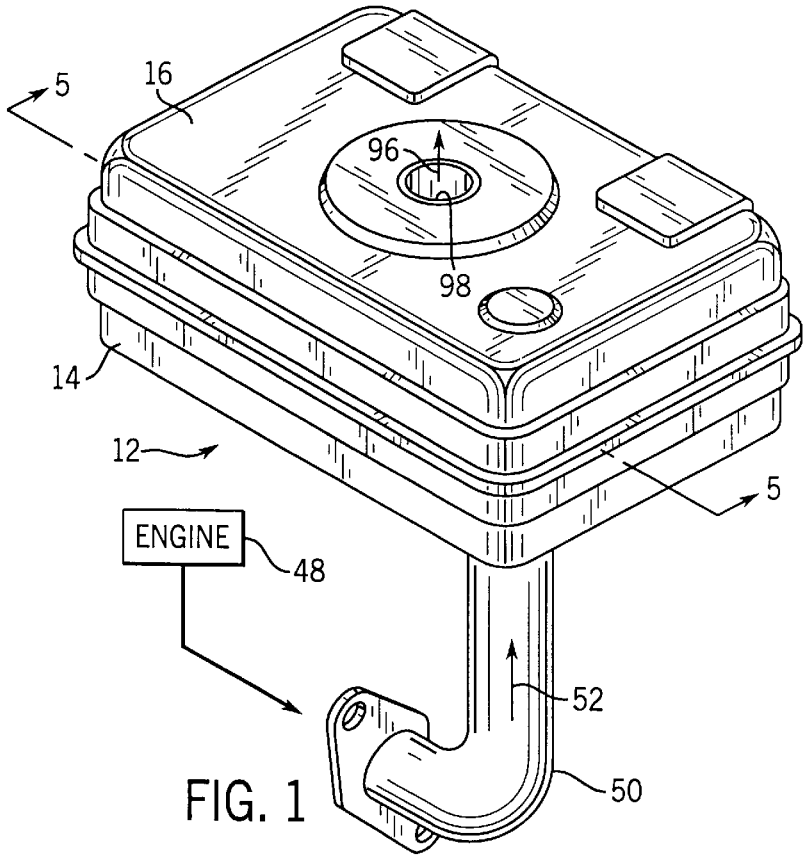
FIG. 1 is an isometric elevational view of a muffler constructed in accordance with the invention.
Figure 2:
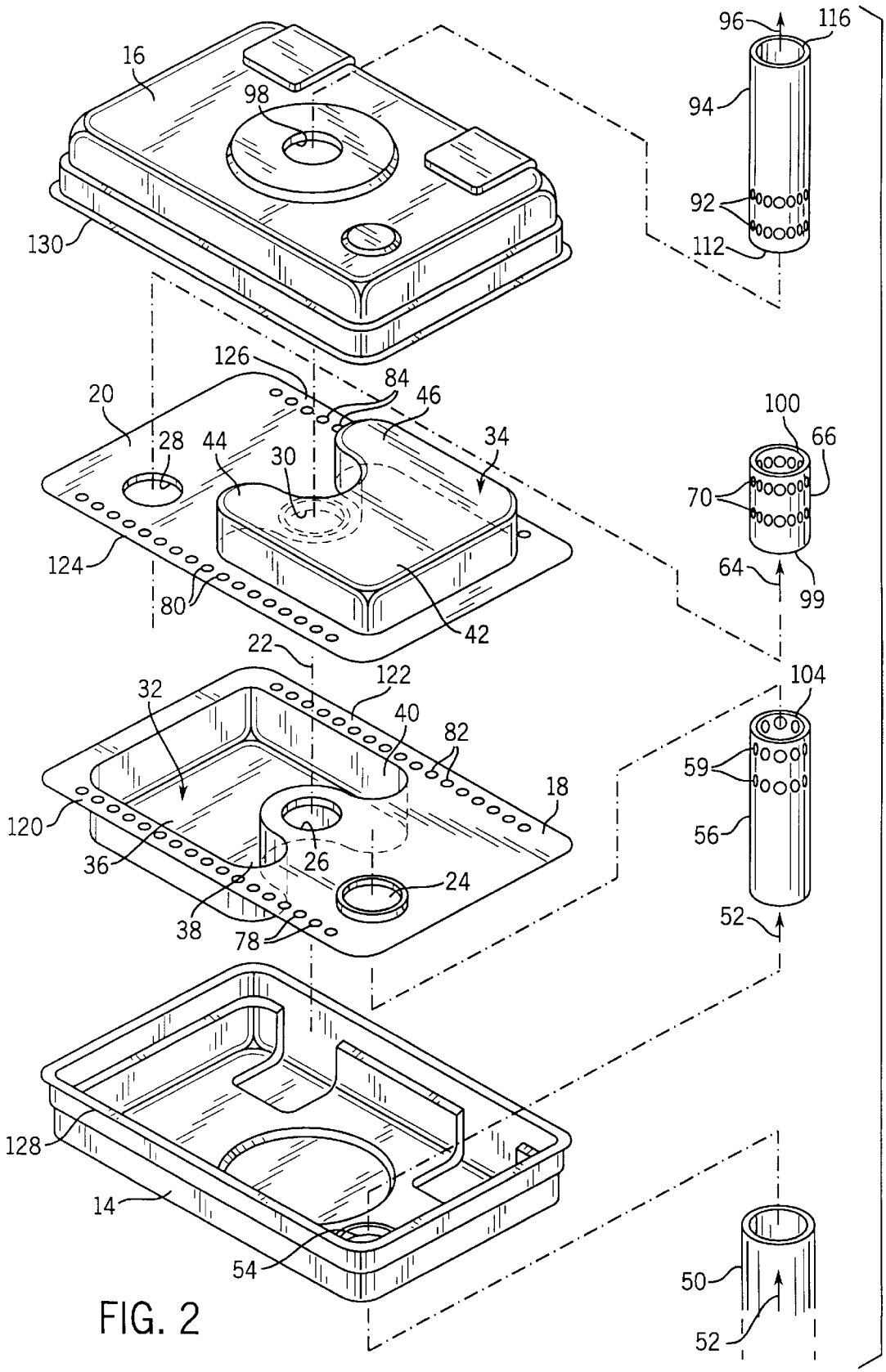
FIG. 2 is an exploded perspective view of the structure of FIG. 1.
Figure 4:
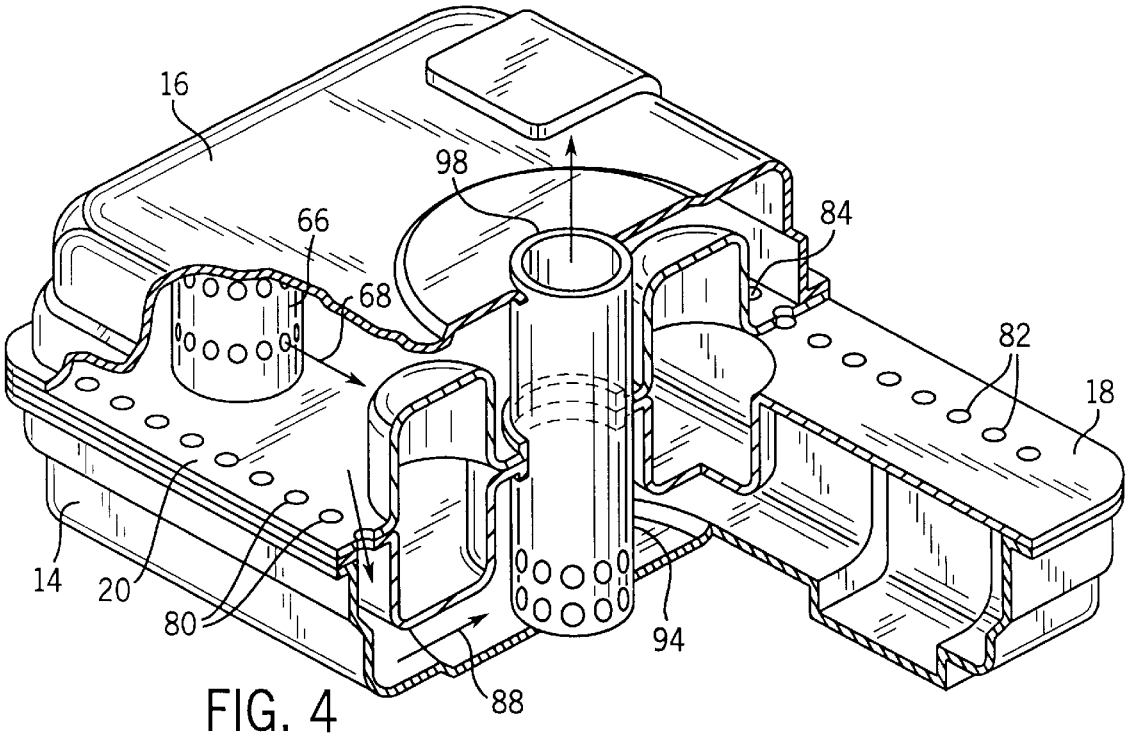
FIG. 4 is another view like FIG. 1, partially cut away.

FIG. 1 shows a muffler 12, FIG. 1, have first and second outer shell members 14 and 16, FIG. 2, and first and second inner baffle members 18 and 20. Inner baffle members 18 and 20 are identical to each other and extend parallel to each other in mirror image relation and rotated 180° relative to each other about an axis 22 perpendicular to such parallel extension. Inner baffle member 18 has first and second exhaust passages 24 and 26 therethrough. Inner baffle member 20 has first and second exhaust passages 28 and 30 therethrough. Exhaust passage 26 through inner baffle 18 is aligned with exhaust passage 30 through inner baffle member 20 along axis 22. Exhaust passages 24 and 28 are laterally offset from each other and from exhaust passages 26, 30. Each of the inner baffle members 18, 20 has an expansion chamber 32, 34, respectively. Exhaust passage 24 through inner baffle member 18 opens into expansion chamber 34 of inner baffle member 20. Exhaust passage 28 through inner baffle member 20 opens into expansion chamber 32 of inner baffle member 18.

Expansion chambers 32, 34 are formed in respective baffle members 18, 20 during stamping, preferably by known deep draw cold forming, and have portions laterally offset from each other, and have portions partially overlapped to provide exhaust flow communication therebetween. Exhaust flow passages 26, 30 are laterally offset from each of the expansion chambers. Expansion chamber 32 is horseshoe-shaped and has a central bight 36 and a pair of spaced arms 38 and 40 extending therefrom. Expansion chamber 34 is a identical and is horseshoe-shaped and has a central bight 42 and a pair of spaced arms 44 and 46 extending therefrom. Exhaust passages 26, 30 extend between the spaced arms 38 and 40, and 44 and 46 of each expansion chamber 32 and 34, respectively. Spaced arms 38 and 40 of expansion chamber 32 are overlapped respectively with spaced arms 44 and 46 of expansion chamber 34.

Figure 3:
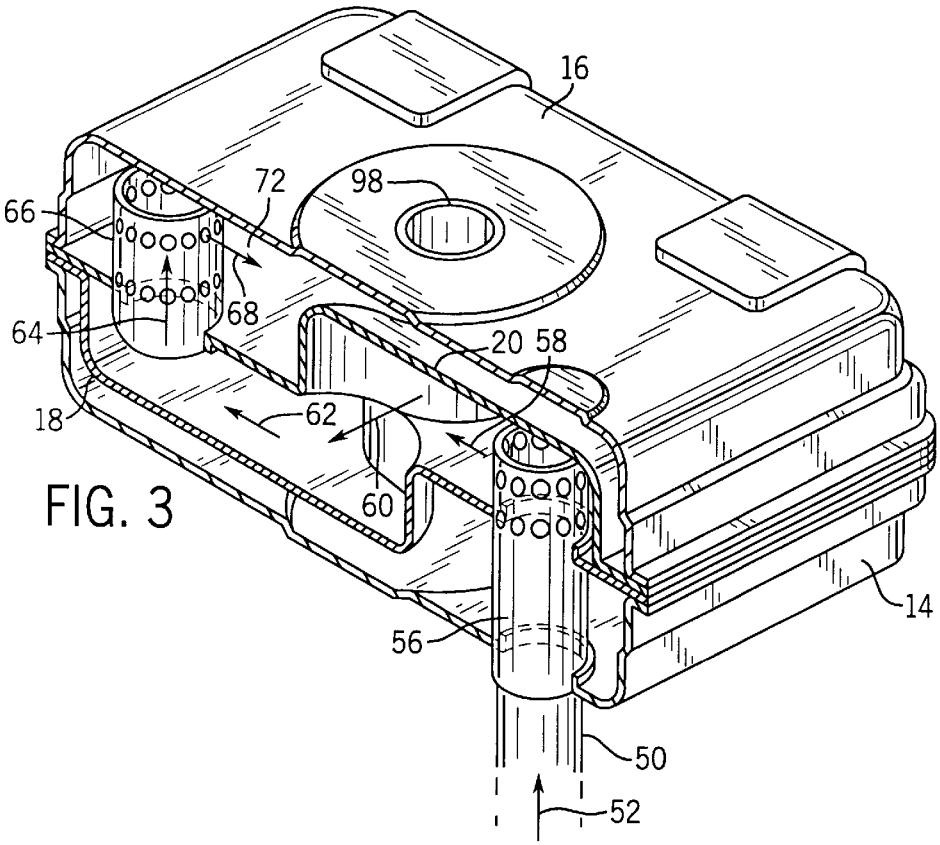
FIG. 3 is a view like FIG. 1, partially cut away.
Figure 5:
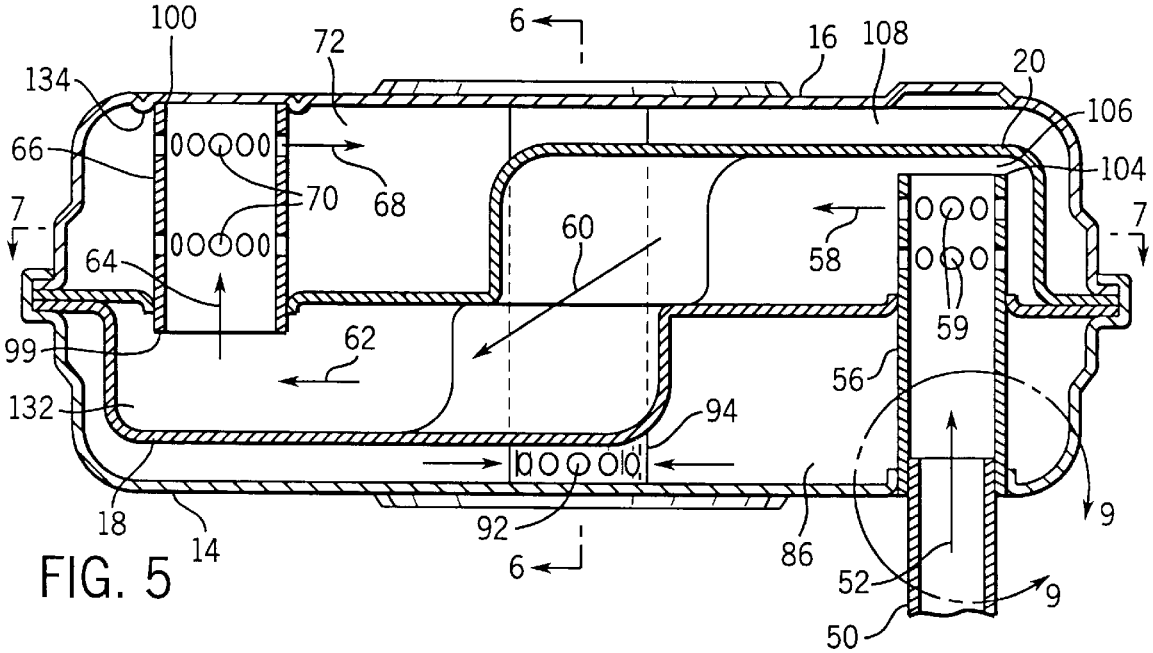
FIG. 5 is a sectional view taken along line 5—5 of FIG. 1.
Figure 6:
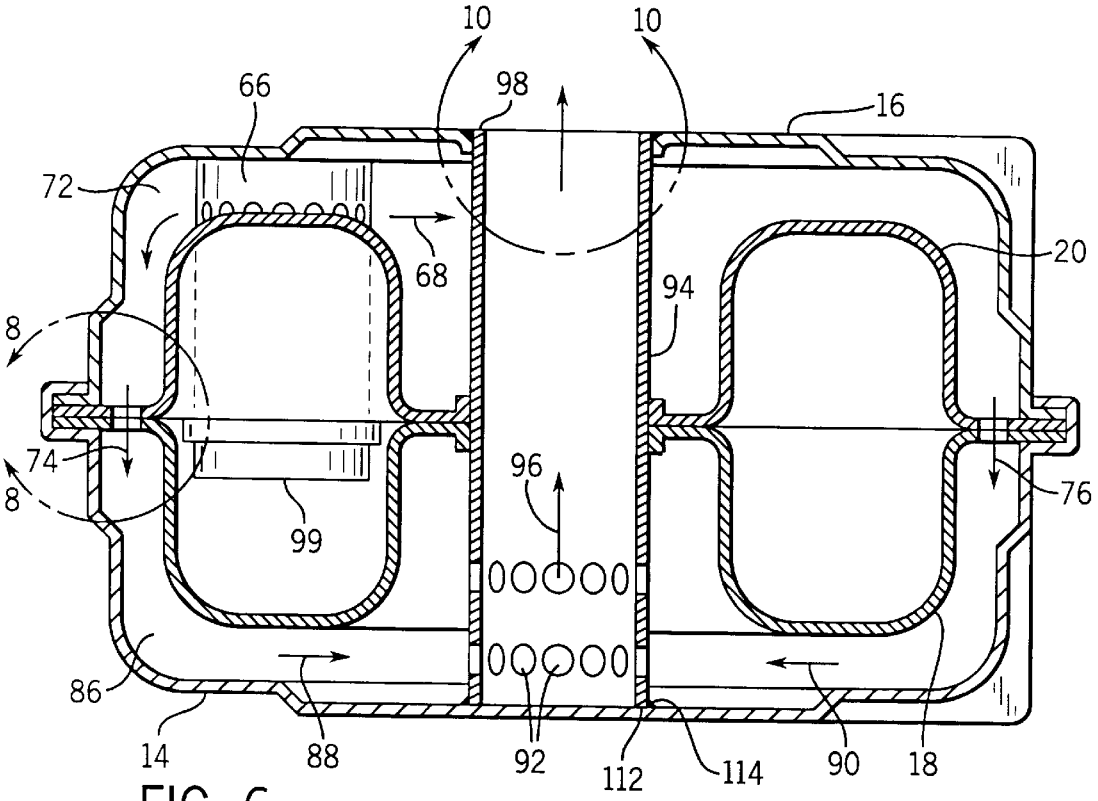
FIG. 6 is a sectional view taken along line 6—6 of FIG. 5.
Figure 7:
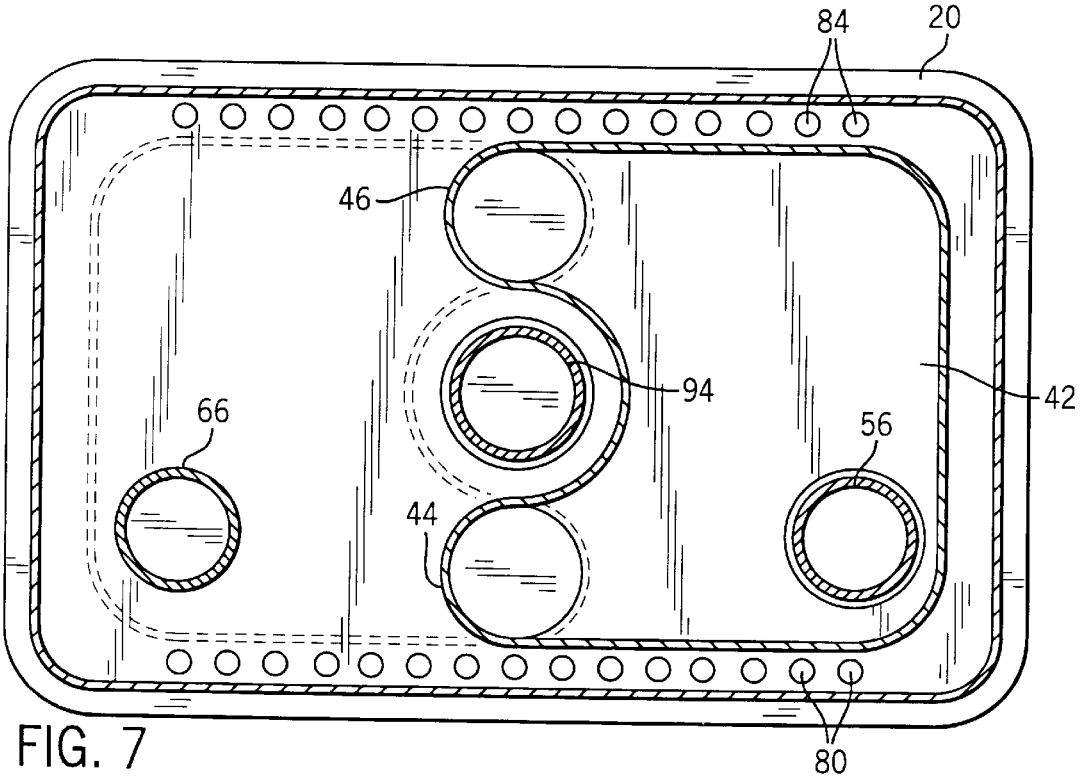
FIG. 7 is a sectional view taken along line 7—7 of FIG. 5.

Exhaust from an internal combustion engine 48, FIG. 1, flows through its exhaust outlet pipe 50 into muffler 12. The exhaust flow path extends axially forwardly, which is upwardly as shown at arrow 52 in FIGS. 1–3 and 5, through opening 54 in outer shell number 14 then along inlet exhaust tube 56 through exhaust passage 24 through inner baffle member 18 into expansion chamber 34 of inner baffle member 20 then laterally as shown at arrow 58, FIGS. 3 and 5, through apertures 59 in inlet exhaust tube 56, through expansion chamber 34 into spaced parallel arms 44, 46 then axially rearwardly and laterally as shown at arrow 60 through spaced arms 44, 46 into spaced arms 38, 40 of expansion chamber 32 of baffle member 18 then laterally in expansion chamber 32 as shown at arrow 62 then axially forwardly as shown at arrow 64 along internal transfer tube 66 through exhaust passage 28 through inner baffle member 20 then laterally as shown at arrow 68 through apertures 70 in internal transfer tube 66 into a chamber 72 between inner baffle member 20 and outer shell member 16 then axially rearwardly as shown at arrows 74 and 76, FIG. 6, FIGS. 6 and 8, through inner baffle members 20 and 18 through a plurality of sets of aligned apertures 78 and 80, and 82 and 84, FIG. 2, along peripheral portions of the inner baffle members then into a chamber 86, FIGS. 5 and 6, between inner baffle member 18 and outer shell member 14 then laterally through chamber 86 as shown at arrows 88, 90, FIG. 6, through apertures 92 in outlet exhaust tube 94 then axially forwardly as shown at arrow 96 through exhaust outlet tube 94 through exhaust passages 26, 30 through inner baffle members 18, 20, respectively, and through opening 98 in outer shell member 16. The axially rearward, downward in FIGS. 1–6, exhaust flow from expansion chamber 34 of inner baffle member 20 is split into spaced parallel paths, namely a first path through arms 46 and 40, and a second path through arms 44 and 38. The exhaust flow path extending axially forwardly, upwardly in FIGS. 1–6, through inner baffle members 18 and 20 from chamber 86 extends between and parallel to such spaced parallel paths and in opposite flow direction relative thereto. Inlet exhaust tube 56 extends axially through outer shell member 14 and inner baffle member 18 and terminates in expansion chamber 34 of inner baffle member 20. Outlet exhaust tube 94 extends axially through outer shell member 16 and inner baffle members 20 and 18 and terminates in chamber 86. Internal transfer tube 66 extends axially through inner baffle member 20, and has an upstream end 99 terminating in expansion chamber 32 of inner baffle member 18, and has a downstream end 100 terminating in chamber 72. Aligned apertures 80 and 78, and 84 and 82, provide a plurality of exhaust flow passages extending axially rearwardly from chamber 72 to chamber 86, arrows 74 and 76, FIG. 6, parallel to outlet exhaust tube 94 and conducting exhaust flow in the opposite direction relative thereto. Expansion chambers 34 and 32 overlap at the noted pair of portions, namely a first portion through arms 46 and 40, and a second portion through arms 44 and 38, which portions are laterally spaced on opposite sides of outlet exhaust tube 94.

Figure 8:
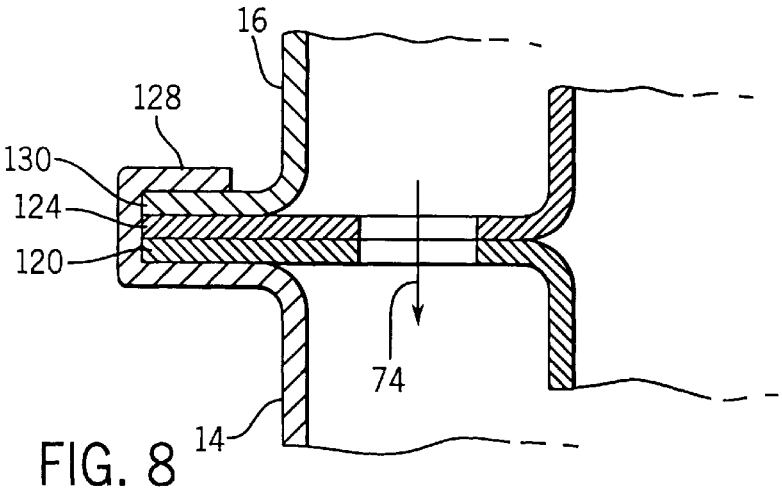
FIG. 8 is a sectional view taken along line 8—8 of FIG. 6.
Figure 9:
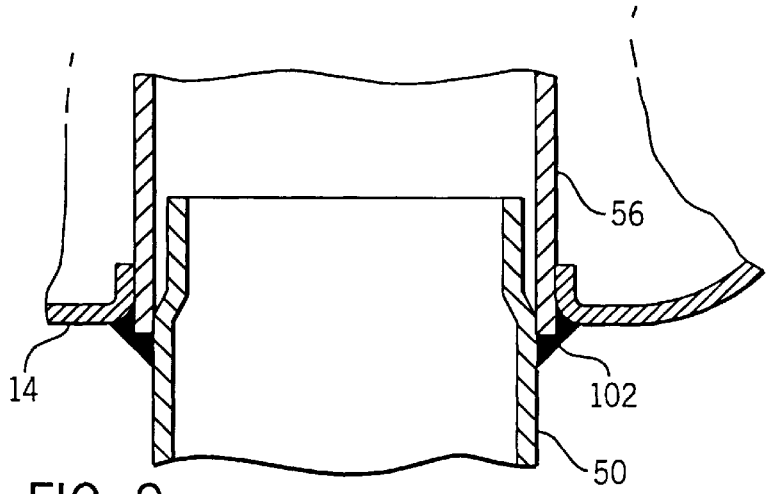
FIG. 9 is a sectional view taken along line 9—9 of FIG. 5.
Figure 10:
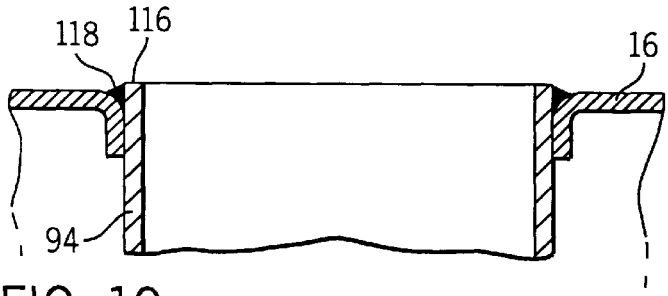
FIG. 10 is a sectional view taken along line 10—10 of FIG. 6.

Inlet exhaust tube 56 conducts exhaust flow axially forwardly into the muffler as shown at arrow 52. Inlet exhaust tube 56 and exhaust pipe 50 are preferably welded to outer shell 14, as shown at weldment 102, FIG. 9, or alternatively by mechanical crimping, or other various known attachment techniques. Inlet exhaust tube 56 extends through outer shell member 14 at opening 54 and though inner baffle member 18 at passage 24 and has an inner end 104 facing inner baffle member 20 in expansion chamber 34. Inner end 104 is preferably spaced by a small gap 106, FIG. 5, from inner baffle member 20. In an alternate embodiment, inner end 104 engages inner baffle member 20 in expansion chamber 34 with no gap 106 therebetween. Inner baffle member 20 is axially between inner end 104 of inlet exhaust tube 56 and outer shell member 16. There is a gap 108 between outer shell member 16 and inner baffle member 20 at expansion chamber 34, which gap 108 forms part of chamber 72. Outlet exhaust tube 94 conducts exhaust flow axially out of the muffler as shown at arrow 96. Outlet exhaust tube 94 extends through outer shell member 16 at opening 98 and through inner baffle members 20 and 18 at passages 30 and 26, respectively, and has an inner end 112 facing outer shell member 14 and preferably engaging outer shell member 14 and welded thereto at weldment 114, FIG. 6, or other affixment. Outer end 116 of outlet exhaust tube 94 is affixed to outer shell member 16 at weldment 118, FIG. 10, or other affixment. Inlet exhaust tube 56 and outlet exhaust tube 94 conduct exhaust flow in the same axial direction, namely axially forwardly, which is upwardly in the drawings, as shown at respective arrows 52 and 96. Inlet exhaust tube 56 conducts exhaust flow axially forwardly into muffler 12 as shown at arrow 52. Outlet exhaust tube 94 conducts exhaust flow axially forwardly out of the muffler as shown at arrow 96. Outer peripheral flanges 120 and 122 of inner baffle member 18, and outer peripheral flanges 124 and 126 of inner baffle member 20, have the noted sets of aligned apertures 78, 80, 82, 84 therethrough conducting exhaust flow axially rearwardly therethrough, arrows 74 and 76, FIG. 6, in a direction opposite to the noted axially forward direction. The first set of aligned apertures are provided by apertures 80 and 78 in respective flanges 124 and 120 of respective inner baffle members 20 and 18, and the second set of aligned apertures is provided by apertures 84 and 82 in respective flanges 126 and 122 of respective inner baffle members 20 and 18. The noted outer peripheral flanges are sandwiched between outer shell members 14 and 16, FIGS. 5, 6, 8, and are welded or otherwise affixed to each other. In one embodiment, the upper outer lip 128 of outer shell member 14, FIG. 8, is wrapped around abutting flanges 120, 124, and lower outer lip 130 of outer shell member 16, and pressfit or mechanically crimped thereagainst, or welded, or otherwise affixed. Each of the noted apertures 78, 80, 82, 84 is substantially smaller than each of openings 54, 24, 28, 26, 30, 98 in the noted outer shell members 14, 16 and inner baffle members 18, 20. Internal transfer tube 66 conducts exhaust flow axially forwardly as shown at arrow 64. Internal transfer tube 66 extends through inner baffle member 20 at opening 28. Internal transfer tube 66 has the noted upstream end 99 facing inner baffle member 18 at expansion chamber 32 and spaced therefrom by a gap 132, FIG. 5. Internal transfer tube 66 has the noted downstream and 100 facing outer shell member 16 and preferably engaging same and affixed thereto by mechanical crimping as at 134, or other affixment. Internal transfer tube 66 conducts exhaust flow in the same axial direction as inlet and outlet exhaust tubes 56 and 94.

It is recognized that various equivalents, alternatives and modifications are possible within the scope of the appended claims.

What is claimed is:

1. A muffler comprising first and second outer shell members, and first and second inner baffle members, said first and second inner baffle members being identical to each other and extending parallel to each other and rotated 180° relative to each other about an axis perpendicular to said parallel extension.

2. The muffler according to claim 1 wherein each of said first and second identical inner baffle members has first and second exhaust passages therethrough.

3. The muffler according to claim 2 wherein said second exhaust passage through said first inner baffle member is aligned with said second exhaust passage through said second inner baffle member.

4. The muffler according to claim 3 wherein said second exhaust passage through said first inner baffle member is aligned with said second exhaust passage through said second inner baffle member along said axis.

5. The muffler according to claim 2 wherein said first exhaust passage through said first inner baffle member is laterally offset from said first exhaust passage through said second inner baffle member.

6. The muffler according to claim 5 wherein each of said first and second identical inner baffle members has an expansion chamber, and wherein said first exhaust passage through said first inner baffle member opens into said expansion chamber of said second inner baffle member, and said first exhaust passage through said second inner baffle member opens into said expansion chamber of said first inner baffle member.

7. The muffler according to claim 1 wherein each of said first and second identical inner baffle members has first and second exhaust passages therethrough, said second exhaust passage through said first inner baffle member is aligned with said second exhaust passage through said second inner baffle member along said axis, said first exhaust passage through said first inner baffle member is laterally offset from said first exhaust passage through said second inner baffle member and from said second exhaust passages, each of said first and second identical inner baffle members has an expansion chamber, said first exhaust passage through said first inner baffle member opens into said expansion chamber of said second inner baffle member, said first exhaust passage through said second inner baffle member opens into said expansion chamber of said first inner baffle member.

8. A muffler comprising first and second outer shell members, and first and second inner baffle members, said first and second inner baffle members extending parallel to each other and having oppositely facing laterally offset formed expansion chambers partially overlapped to provide exhaust flow communication therebetween, wherein each of said first and second inner baffle members has first and second exhaust passages therethrough, said second exhaust passages being aligned with each other and laterally offset from each of said expansion chambers, said first exhaust passage through said first inner baffle member being laterally offset from said second exhaust passages and from said first exhaust passage through said second inner baffle member and opening into said expansion chamber of said second inner baffle member, said first exhaust passage through said second inner baffle member being laterally offset from said second exhaust passages and from said first exhaust passage through said first inner baffle member and opening into said expansion chamber of said first inner baffle member.

9. The muffler according to claim 8 wherein each of said expansion chambers is horseshoe-shaped and has a central bight and a pair of spaced arms extending therefrom, said second exhaust passages extending between said spaced arms of each of said expansion chambers, said spaced arms of said expansion chamber of said first inner baffle member being overlapped respectively with said spaced arms of said expansion chamber of said second inner baffle member.

10. The muffler according to claim 9 comprising an exhaust flow path extending axially forwardly through said first exhaust passage through said first inner baffle member into said expansion chamber of said second inner baffle member then laterally through said expansion chamber of said second inner baffle member in spaced parallel paths into said spaced arms of said expansion chamber of said second inner baffle member then axially rearwardly through said spaced arms of said expansion chamber of said second inner baffle member into said spaced arms of said expansion chamber of said first inner baffle member then laterally in said expansion chamber of said first inner baffle member then axially forwardly through said first exhaust passage through said second inner baffle member.

11. A muffler comprising first and second outer shell members, and first and second inner baffle members, said first and second inner baffle members extending parallel to each other and having oppositely facing laterally offset formed expansion chambers partially overlapped to provide exhaust flow communication therebetween, wherein each of said first and second inner baffle members has a plurality of exhaust passages therethrough, and comprising an exhaust flow path through said muffler extending axially forwardly through said first outer shell member then axially forwardly through said first inner baffle member into said expansion chamber of said second inner baffle member then laterally through said expansion chamber of said second inner baffle member then axially rearwardly into said expansion chamber of said first inner baffle member at said overlap then laterally through said expansion chamber of said first inner baffle member then axially forwardly through said second inner baffle member into a chamber between said second inner baffle member and said second outer shell member then axially rearwardly through said second and first inner baffle members through a plurality of aligned apertures along peripheral portions of said inner baffle members then into a chamber between said first inner baffle member and said first outer shell member then axially forwardly through said first and second inner baffle members and said second outer shell member.

12. The muffler according to claim 11 wherein said axial rearward exhaust flow from said expansion chamber of said second inner baffle member to said expansion chamber of said first inner baffle member is split into spaced parallel paths, and wherein said exhaust flow path extending axially forwardly through said first and second inner baffle members from said chamber between said first inner baffle member and said first outer shell member extends between and parallel to said spaced parallel paths and in opposite flow direction relative thereto.

13. A muffler comprising first and second outer shell members, and first and second inner baffle members said first and second inner baffle members extending parallel to each other and having oppositely facing laterally offset formed expansion chambers partially overlapped to provide exhaust flow communication therebetween and comprising an inlet exhaust tube extending axially through said first outer shell member and said first inner baffle member and terminating in said expansion chamber of said second inner baffle member, and an outlet exhaust tube extending axially through said second outer shell member and said second and first inner baffle members and terminating in a chamber between said first inner baffle member and said first outer shell member.

14. The muffler according to claim 13 comprising an internal transfer tube extending axially through said second inner baffle member and having an upstream end terminating in said expansion chamber of said first inner baffle member and having a downstream end terminating in a chamber between said second inner baffle member and said second outer shell member.

15. The muffler according to claim 13 wherein said first and second inner baffle members have a plurality of aligned apertures therethrough providing a plurality of exhaust flow passages extending axially rearwardly from a chamber between said second inner baffle member and said second outer shell member to a chamber between said first inner baffle member and said first outer shell member.

16. The muffler according to claim 13 wherein said expansion chambers overlap at a pair of portions laterally spaced on opposite sides of said outlet exhaust tube and providing spaced parallel exhaust flow passages extending axially rearwardly parallel to said outlet exhaust tube and conducting exhaust flow in the opposite direction relative thereto.

17. A muffler comprising first and second outer shell members, first and second inner baffle members, said first and second inner baffle members having outer peripheral flanges sandwiched between said outer shell members, an inlet exhaust tube conducting exhaust flow axially into said muffler, said inlet exhaust tube extending through said first outer shell member and through said first inner baffle member and having an inner end facing said second inner baffle member, said second inner baffle member being axially between said inner end of said inlet exhaust tube and said second outer shell member, an outlet exhaust tube conducting exhaust flow axially out of said muffler, said outlet exhaust tube extending through said second outer shell member and through said first and second inner baffle members and having an inner end facing said first outer shell member.

18. The muffler according to claim 17 wherein said inlet and outlet exhaust tubes conduct exhaust flow in the same axial direction, said inlet exhaust tube conducts exhaust flow axially forwardly into said muffler, said outlet exhaust tube conducts exhaust flow axially forwardly out of said muffler, and wherein said outer peripheral flanges of said first and second inner baffle members have a plurality of aligned apertures therethrough conducting exhaust flow axially rearwardly therethrough in a direction opposite to said axially forward direction.

19. The muffler according to claim 18 wherein said inlet and outlet exhaust tubes extend through respective openings in said first and second outer shell members and said first and second inner baffle members, and wherein each of said apertures in said outer peripheral flanges of said first and second inner baffle members is substantially smaller than each of said openings in said first and second outer shell members and said first and second inner baffle members through which said exhaust tubes extend.

20. The muffler according to claim 18 wherein said apertures through said outer peripheral flanges conduct exhaust from a chamber between said second outer shell member and said second inner baffle member to a chamber between said first outer shell member and said first inner baffle member.

21. The muffler according to claim 17 comprising an internal transfer tube conducting exhaust flow axially forwardly, said internal transfer tube extending through said second inner baffle member and having an upstream end facing said first inner baffle member and having a downstream end facing said second outer shell member, said internal transfer tube conducting exhaust flow in the same axial direction as said inlet and outlet exhaust tubes.

* * * * *